US007040728B2

(12) United States Patent
Merz et al.

(10) Patent No.: US 7,040,728 B2
(45) Date of Patent: May 9, 2006

(54) GEOMETRY FOR A DUAL LEVEL FLUID QUANTITY SENSING REFILLABLE FLUID CONTAINER

(75) Inventors: Eric A. Merz, Palmyra, NY (US); Brian S. Hilton, Rochester, NY (US)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/455,357

(22) Filed: Jun. 6, 2003

(65) Prior Publication Data

US 2004/0246283 A1 Dec. 9, 2004

(51) Int. Cl.
*B41J 2/195* (2006.01)

(52) U.S. Cl. ..... 347/7; 347/85; 347/86

(58) Field of Classification Search ..... 347/7, 347/85, 86, 19; 250/573, 577; 359/432; 73/293

See application file for complete search history.

(56) References Cited

U.S. PATENT DOCUMENTS 3,648,521 A * 3/1972 Amendolia ..... 73/293
5,231,534 A * 7/1993 Kato ..... 359/432
5,616,929 A 4/1997 Hara ..... 250/573
5,997,121 A 12/1999 Altfather et al. ..... 347/7
6,137,503 A * 10/2000 Hashimoto et al. ..... 347/19
6,173,609 B1 * 1/2001 Modlin et al. ..... 73/293
6,520,612 B1 2/2003 Merz et al. ..... 347/7
6,796,627 B1 * 9/2004 Kimura et al. ..... 347/7

* cited by examiner

*Primary Examiner*—Hai Pham
*Assistant Examiner*—Lam Nguyen
(74) *Attorney, Agent, or Firm*—Oliff & Berridge, PLC

(57) ABSTRACT

A fluid reservoir sensing system includes a pair of optical prisms that reflect light when a fluid level is below one of the pair of prisms. The pair of optical prisms includes a low prism usable to sense a low liquid level in the fluid reservoir, and a high prism usable to sense a high liquid level in the fluid reservoir. The fluid reservoir sensing system optionally includes an emitter and a photosensor. The emitter projects light through at least one of the low prism to the low incident surface and the high prism to the high incident surface. The photosensor senses light reflected from the low prism while the liquid is below the low prism. The photosensor also senses light from the high prism while the liquid level is below the high prism.

12 Claims, 5 Drawing Sheets

GEOMETRY FOR A DUAL LEVEL FLUID QUANTITY SENSING REFILLABLE FLUID CONTAINER

BACKGROUND OF THE INVENTION

1. Field of Invention

This invention relates to sensing fluid quantity in a refillable fluid container.

2. Description of Related Art

Fluid ejector systems, such as drop-on-demand liquid ink printers, have at least one fluid ejector from which droplets of fluid are ejected towards a receiving sheet. Scanning inkjet printers are equipped with fluid ejection heads containing fluid ink. The ink is applied to a sheet in an arrangement based on print data received from a computer, scanner or similar device. To control the delivery of the fluid to the sheet, fluid ejection heads are moved across the sheet to provide the fluid to the sheet, which is ejected as drops. These drops correspond to a liquid volume designated as pixels. Each pixel is related to a quantity needed to darken or cover a particular unit area.

In order to lower cost and improve performance by limiting inertia, moving-head fluid ejection systems are designed with low weight fluid ejection heads that often use refillable fluid containers. In order to minimize weight, the fluid ejection heads contain a relatively small quantity of fluid. Consequently, the fluid ejection heads (or their fluid reservoirs) must either be replaced or refilled periodically. Replaceable cartridges are commonly used in home-use printers. Some heavier-use printers in industry attach the fluid ejection head via an umbilical tube to a larger tank for continuous refilling. Other heavier-use printers refill the fluid ejection head periodically.

SUMMARY OF THE INVENTION

Replacing cartridges requires frequent interaction by the user, and is considered disadvantageous for fluid ejectors used in volume production or connected by a network to the ejection data source. Umbilical systems can be expensive, requiring pressurization, tubing, tube harness dressing, and can suffer performance degradation from moisture loss, pressure fluctuations due to acceleration or temperature variation, and motion hysterisis from tubing harness drag.

One common fluid ejection system is an ink jet printer. In an ink jet printer, periodic refill systems commonly do not accurately meter the ink that is deposited into the printhead. Consequently, the ink reservoir in a printhead must be significantly underfilled in order to avoid excess ink spilling out of the refilled printhead ink reservoir. Consequently, this under-filling wastes space and reduces the productivity of the printer due to the greater frequency of refill operations.

Similarly, other containers for consumable fluids in various applications of fluid ejection may require sensing fluid level for refill or replacement of the fluid in a fluid reservoir. Such applications include, but are not limited to dispensing medication, pharmaceuticals, photo results and the like onto a receiving medium, injecting reducing agents into engine exhaust to control emissions, draining condensation during refrigeration, etc. Other technologies that use refillable fluid containers include fuel cells, fuel tanks, chemical handling systems and electric batteries. Fluid level sensing in fluid container in these technologies is difficult because electrical fluid sensing may introduce hazards, e.g., spark ignition into the fluid contained in the fluid container, or in which the fluid may deteriorate the electrical sensors, e.g., from corrosion.

Thus, an improved method of sensing fluid quantity is desirable to determine when a fluid refill operation is appropriate, as well as to provide an improved, and ideally, optimum quantity of fluid during the refill operation.

This invention provides devices and methods for optically sensing reflected light to determine a fluid level.

This invention separately provides devices and methods for optically sensing reflected light to determine whether a fluid level is above or below a high level detector and a low level detector, each having an emitter and a photosensor.

This invention separately provides devices and methods for reflecting light by prisms located at separate levels within the fluid reservoir.

This invention separately provides devices and methods for moving the fluid reservoir across the emitter and photosensor devices.

In various exemplary embodiments, a sensor system for a fluid reservoir includes a pair of optical prisms to reflect light from an emitter to a photosensor. The sensor system determines whether the fluid level descends below one or both of the pair of prisms. The pair of optical prisms includes a low prism at a low liquid level in the fluid reservoir, and a high prism at a high liquid level in the fluid reservoir. The emitter projects the light ray through at least one of the low prism to the low incident surface and the high prism to the high incident surface. The photosensor senses the light ray reflected from the low prism when the liquid is below the low prism. The photosensor also senses the light ray from the high prism when the liquid level is below the high prism. More particularly, the sensor uses the absence of the light ray to detect when the fluid level rises above the high incident surface of the high prism.

These and other features and advantages of this invention are described in, or are apparent from, the following detailed description of various exemplary embodiments of the systems and methods according to this invention.

BRIEF DESCRIPTION OF THE DRAWINGS

Various exemplary embodiments of the devices, systems and methods of this invention will be described in detail with reference to the following figures, wherein.

DETAILED DESCRIPTION OF EXEMPLARY EMBODIMENTS

The following detailed description of various exemplary embodiments of the refillable fluid containers usable with fluid ejection systems or other technologies that store and consume fluids, according to this invention may refer to one specific type of fluid ejection system, e.g., an inkjet printer that uses the refillable fluid containers according to this invention, for sake of clarity and familiarity. However, it should be appreciated that the principles of this invention, as outlined and/or discussed below, can be equally applied to any known or later-developed fluid ejection systems, beyond the ink jet printer specifically discussed herein.

A molded optical prism can be used to sense the presence of fluid at the level of the prism in a refillable fluid container or reservoir. The optical prism involves a faceted trapezoid along the wall of the refillable fluid container or reservoir to reflect light depending on the presence of fluid adjacent to the facets.

Figure 1:
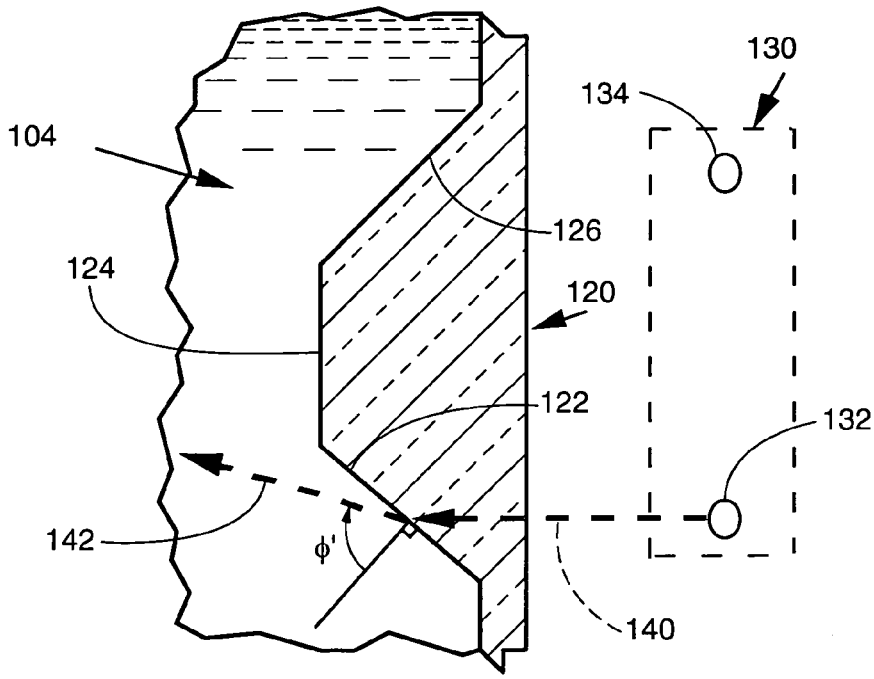
FIG. 1 (RELATED ART)
FIG. 1 shows an optical prism in a fluid reservoir filled with fluid in a conventional arrangement.
Figure 2:
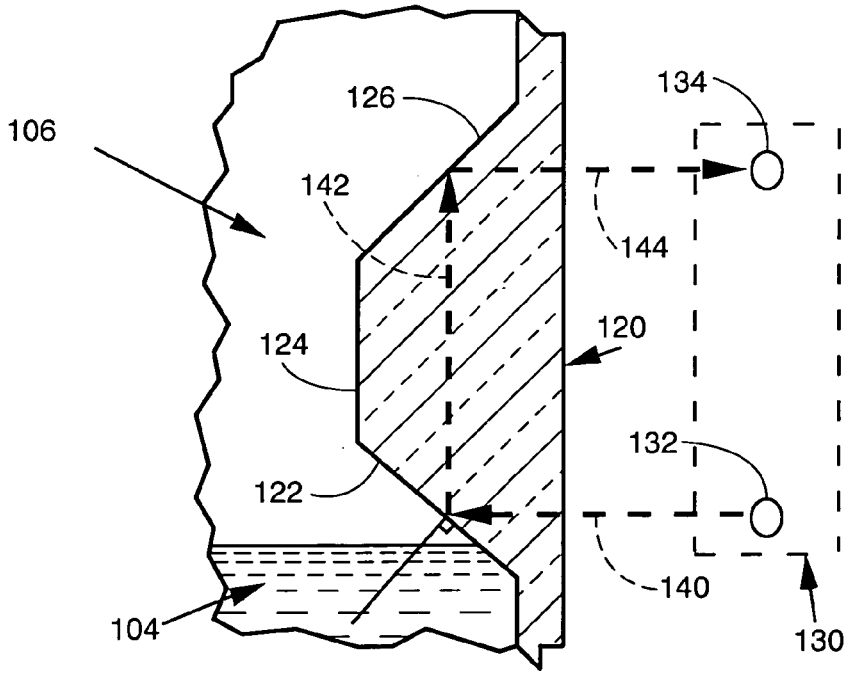
FIG. 2 (RELATED ART)
FIG. 2 shows the optical prism in the fluid reservoir arrangement of FIG. 1 with the fluid substantially consumed.

FIG. 1 shows an elevation view of a section along one wall 102 of a refillable fluid container or reservoir 100 usable to contain a fluid 104. FIG. 2 shows air 106 that replaces the fluid 104 as it is consumed. As shown in FIGS. 1 and 2, an optical sensor 110 detects the fluid 104 in the reservoir 100 and includes an optical prism 120 and an optical detector 130. The optical prism 120 is molded into the wall 102, and both are formed of transparent polystyrene.

The optical prism 120 includes a number of facets 122, 124 and 126. The facets 122 and 126 are slanted 45° away from the wall 102 towards each other. The facet 124 is parallel to the wall 102 and joins the facets 122 and 126 at 45° angles.

The optical detector includes a light emitter 132 and a photosensor 134 facing the optical prism 120 and placed outside of the interior of the reservoir 100. The light emitter 132 projects an incident light ray 140 to the facet 122. If the level of the fluid 104 is higher than the facets 122, 124 and 126, as shown in FIG. 1, the light ray 140 is substantially refracted into the fluid 104 as a refracted ray 142. If the fluid 104 is depleted so that the level of the fluid 104 is below the projection of the light emitter 132, the light ray 140 is perpendicularly reflected as a reflected ray 144 from the facet 122 to the facet 126, and perpendicularly reflected further as a reflected ray 146 from the facet 126 to the photosensor 134.

The polystyrene from which the wall 102 and the optical prism 120 are composed has a refractive index $n_p$ of 1.589. By contrast, when the fluid 104 is a liquid ink, the fluid 104 has a refractive index $n_f$ of about 1.33, while the air 106 that replaces the consumed fluid 104 has a refractive index $n_a$ of 1.0.

When the light ray 140 strikes a surface plane, such as the facet 122 at an incident angle $\phi$ (relative to normal incidence, i.e., perpendicular to the plane), the angle of refraction depends on the ratio of refractive indices. Snell's law requires that the product of a first refractive index n and the sine of the first incident angle $\phi$ be equal to the product of a second refractive index n' and the sine of a second incident angle $\phi'$. This can be expressed as n sin +=n' sin $\phi'$. See Fundamentals of Optics by Jenkins and White, pp. 4–6.

The light ray 140 approaches the plane on the facet 122 at an incident angle $\phi$ of 45°. As the incident angle $\phi$ approaches 90°, the refracted ray 142 approaches a critical angle $\phi_c$, from which no light ray can be refracted, but instead is either absorbed or reflected. The critical angle for the boundary separating two optical media is the smallest angle of incidence and can be expressed as $\phi_c = \sin^{-1}(n'/n)$. See *Fundamentals*, pp. 14–17.

For an interface between polystyrene and liquid ink, the critical angle $\phi_c$ is 56.8°, which is greater than the incident angle of 45°. Hence, when the fluid 104 is liquid ink, the light ray 140 will be transmitted into the fluid 104 as the refracted ray 142. By contrast, for an interface between the polystyrene and the air, the critical angle $\phi_c$ is only 39.0°, which is less than the incident angle of 45°. Hence, the air 106 opposite the facets 122 and 126 causes the light ray 140 to be reflected as the reflected rays 142 and 144.

In general, as long as the fluid 104 has an index of refraction of at least $n_p \sin \phi_c$, the light will not be reflected from the facet 122 towards the facet 126, where $n_p$ is the index of refraction of the material used to form the facet 122. For polypropylene at an incident angle of 45°, the minimum allowable index of refraction for the fluid 104 is approximately $n_f$ of 1.12. Of course, different minimum values of the index of refraction of the fluid will occur as the angle of the facets 122 and 126 to the light rays 140, 144 and 146 changes and/or as the index of refraction $n_p$ of the material used to form the facets 122 and 126 changes.

Consequently, the light ray 140 at an incident angle of 45° to the interface plane for the facet 122 will be either transmitted into the liquid ink or any fluid 104 having an index of refraction of at least 1.124, or else reflected from the air 106 interface. The photosensor 134 can detect the reflected ray 144, but not the refracted ray 142. Thus, the optical prism 120 placed at a particular level in the fluid reservoir 100 can detect whether the liquid ink 104 is present at that level.

It should be appreciated that, in various exemplary embodiments, the optical prism 120 can be composed of any of several materials transparent in the wavelength of light being transmitted to the fluid. Such materials include commonly available polymers, including, for example, polypropylene (atactic), which has a refractive index of 1.474; polymethyl methacrylate, which has a refractive index of 1.489; polyethylene, which has a refractive index of 1.510; and polycarbonate which has a refractive index of 1.586.

It should also be appreciated that, in various exemplary embodiments, the optical prism 120 can be used across a wide spectrum of electromagnetic radiation wavelengths. Such wavelengths include long infrared (8–14 μm) wavelengths, mid infrared (3–6 μm) wavelengths, near infrared (0.75–2 μm) wavelengths, visible light (0.38–0.75 μm) wavelengths and near ultraviolet (0.2–0.38 μm) wavelengths.

In general, while the term "light" is used herein, it should be understood that this term is not limited to visible light wavelengths, or even to wavelengths indicated above. Rather, "light" is intended to encompass electromagnetic radiation of any appropriate wavelength, so long as the material is at least partially transmissive at that wavelength and Snell's law holds.

Examples of the optical prism are disclosed in U.S. Pat. No. 5,616,929 to Hara et al. and in U.S. Pat. No. 5,997,121 to Altfather et al., each of which is incorporated herein by reference in its entirety. The 929 patent discloses a total reflection prism and a Porro prism for visual observation. The 121 patent discloses the Porro prism with double reflections enabling a light source and a photosensor to be mounted adjacently mounted.

Figure 3:
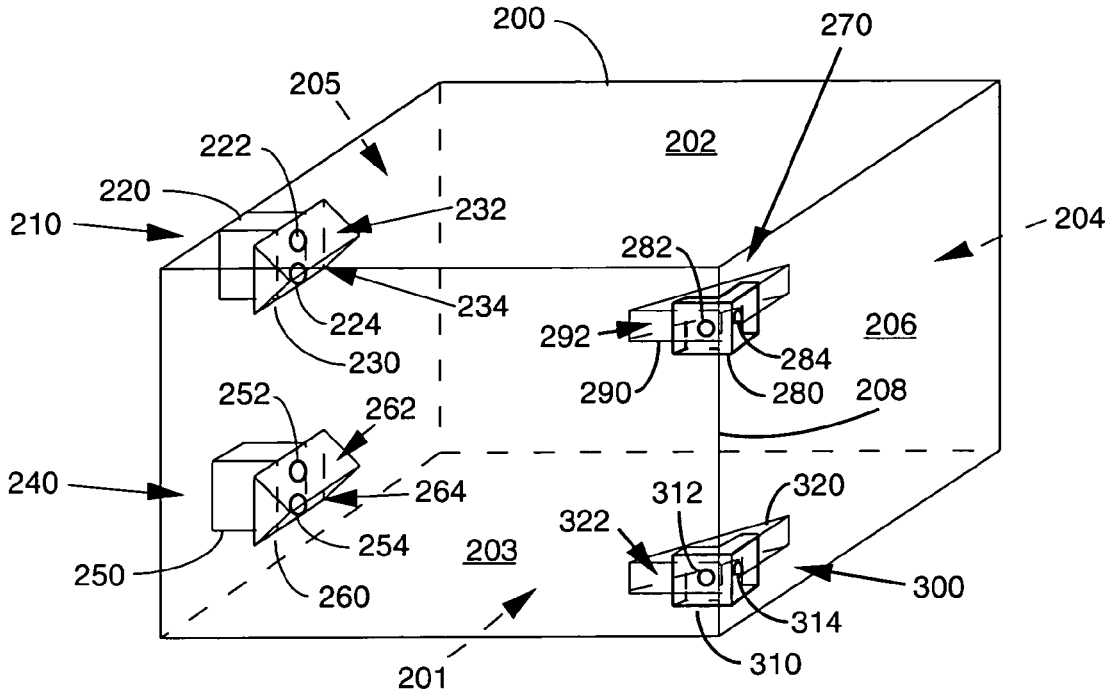
FIG. 3 is an isometric view of first and second exemplary embodiments of a refillable fluid container having sensors in accordance with this invention.

FIG. 3 shows an isometric view of one exemplary embodiment of a refillable fluid container or reservoir 200 and a first exemplary embodiment of a pair of fluid level sensor systems 210 and 240 according to this invention. As shown in FIG. 3, the fluid reservoir 200 includes a bottom wall 201, a top wall 202, a front wall 203, a rear wall 204, a left wall 205 and a right wall 206. The pair of fluid level sensor systems 210 and 240 sense upper and lower fluid levels. These fluid level sensor systems 210 and 240 are mounted on the left wall 205 for illustrative purposes only.

The upper fluid level sensor system 210 includes an upper detector 220 and an upper optical Porro prism or prism target 230. The upper detector 220 includes a high emitter 222 and a high photosensor 224. The upper prism or sensor target 230 includes a high first reflector plane 232 and a high second reflector plane 234.

The lower fluid level sensor system 240 includes a lower detector 250 and a lower optical Porro prism or sensor target 260. The lower detector 250 includes a low emitter 252 and a low photosensor 254. The lower prism or sensor target 260 includes a low first reflector plane 262 and a low second reflector plane 264.

The high and low first reflector planes 232 and 262 are joined perpendicular to the respective high and low second reflector planes 234 and 264 to form incident angles of 45° to the left wall 205. The high and low first reflector planes 232 and 262 are aligned in parallel to their respective emitters 222 and 252. The second reflector planes 234 and 264 are aligned in parallel to their respective with their respective photosensors 224 and 254.

The upper and lower prisms or sensor targets 230 and 260 can be integrally molded with the left wall 205. For a fluid reservoir 200 produced from polystyrene, the sensor systems 210 can determine the fluid level status as outlined above in FIGS. 1 and 2. In particular, a level of the fluid above either of the high reflector planes 232 and 234 would not result in light from the emitter 222 being detected by the high photosensor 224, thus indicating that the fluid reservoir 200 is full. A low level of the fluid fully below at least the low reflector plane 262 would reflect light at least some from the low emitter 252 to the low photosensor 254, thus indicating that the fluid reservoir 200 is approximately or is effectively empty.

A transitional level of the fluid between the sensor systems 210 and 240 would yield light detection by the low photosensor 254 but not the high photosensor 224, thus indicating that the fluid reservoir 200 is at an intermediate fill level. Consequently, the fluid level can be monitored for consumption by determining presence or absence of the fluid at the high level and the low level as the fluid level descends. Additionally, the fluid level can be monitored during refilling by determining presence or absence of the fluid at the low level and the high level as the fluid level ascends.

It should be appreciated that, in various exemplary embodiments, as the high second reflector plane 234 is progressively uncovered during fluid consumption, or covered during a filling operation, the amount of light will change accordingly. Thus, when the high second reflector plane 234 is mostly covered, only a little light will be reflected from the high second reflector plane 234 to the photosensor 224. As a result, the photosensor 224 will output a low amplitude (or low current) signal. In contrast, when the high second reflector plane 234 is mostly uncovered, more, but less than a full amount of light will be reflected from the high second reflector plane 234 to the photosensor 224. As a result, the photosensor will output a higher amplitude (or a higher current) signal.

It should also be appreciated that, in various exemplary embodiments, the photosensors can be considered optional. That is, the fluid level can be equivalently monitored using ambient light through the prisms 230 and 260 and unaided visual observation. In this case, the emitter(s) and the detector(s) can be omitted.

The amplitude (or current) of the photosensor 224, as it varies between a full amount corresponding to the high second reflector plane 234 being fully uncovered and a zero value corresponding to the high second reflector plane 234 being fully covered, can thus be analyzed to determine how much of the high second reflector plane 234 is covered (or uncovered) to obtain a more precise determination of the fluid level around the location of the upper detector 220. Of course, it should be appreciated that this is also applicable to the lower detector 250.

FIG. 3 also shows an isometric view of the exemplary embodiment of the fluid reservoir 200 and a second exemplary embodiment of a second pair of ink level sensor systems 270 and 300. The upper sensor system 270 and the lower sensor 300 are both mounted along a front-right corner 208 joining the front wall 203 and the right wall 206.

The upper fluid level sensor system 270 includes an upper detector 280 and an upper optical Porro prism or sensor target 290. The upper detector 280 includes a high emitter 282 positioned along the front wall 203 and a high photosensor 284 positioned along the right wall 206. The upper prism or sensor target 290 includes a high reflector plane 292 that extends across the front-right corner 208.

The lower fluid level sensor system 300 includes a lower detector 310 and a lower optical Porro prism or sensor target 320. The lower detector 310 includes a low emitter 312 and a low photosensor 314. The lower prism or sensor target 320 includes a low reflector plane 322.

The reflector planes 292 and 322 form incident angles of 45° to the front and right walls 203 and 206 on which the detectors 280 and 310 are mounted. Each of the reflector planes 292 and 322 serves both as an incident plane and as a reflector plane combined into a co-planar plane, like the second reflector planes 234 and 264. The upper and lower prisms 290 and 320 can be molded with the fluid reservoir 200 (as shown along the front-right corner 208). For a fluid reservoir 200 produced from polystyrene, the upper and lower sensor systems 270 and 300 can determine the fluid level status as described above with respect to FIGS. 1 and 2.

In particular, a level of the fluid above the high reflector plane 292 would not cause the high photosensor 284 to detect light from the emitter 282, thus indicating that the fluid reservoir 200 is full. A low level of the fluid below the low reflector plane 322 would reflect light from the low emitter 312 to the low photosensor 314, thus indicating that the fluid reservoir 200 is effectively empty. A transitional level of the fluid between the sensor systems 270 and 300 would yield light detection by the low photosensor 314 but not the high photosensor 284, thus indicating that the fluid reservoir 200 is at an intermediate fill level. Additionally, similarly to that outlined above, with respect to the second reflection planes 232 and 262, when the reflector planes 292 or 322 are only partially covered, the signal from the photosensors 284 and 314 can be analyzed to more precisely locate the fluid level.

Figure 4:
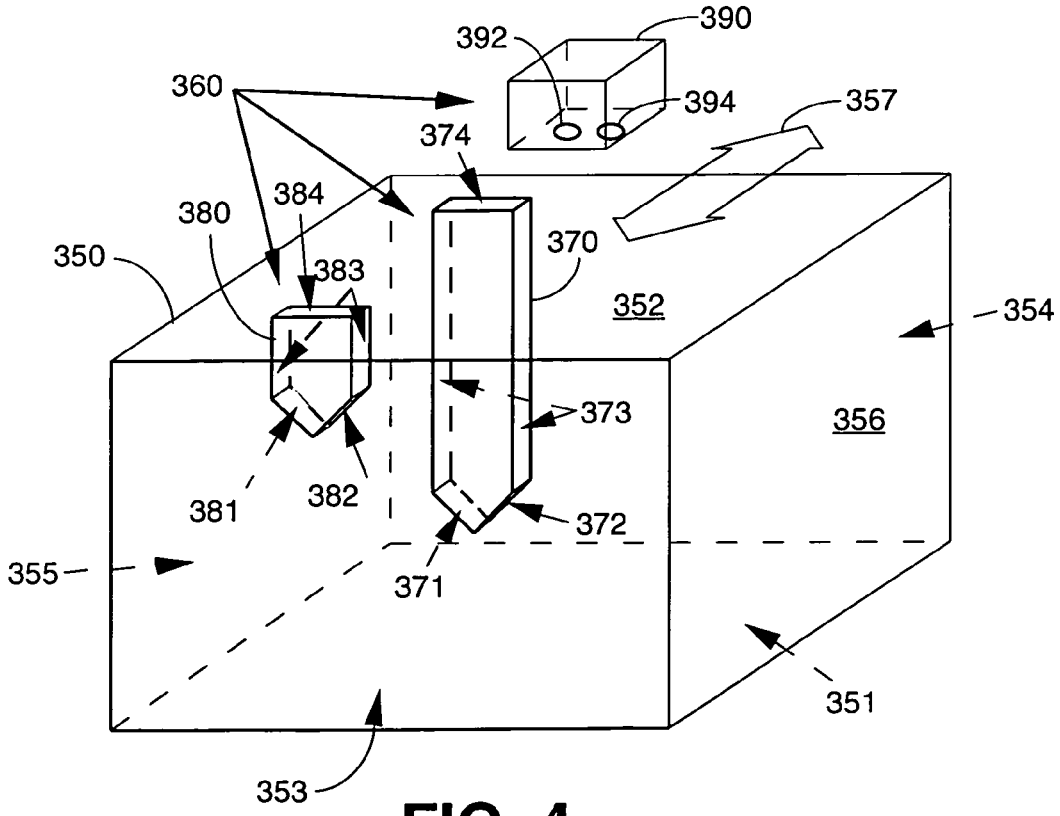
FIG. 4 is an isometric view of a third exemplary embodiment of a refillable fluid container having sensors in accordance with this invention.

FIG. 4 shows an isometric view of an exemplary embodiment of a refillable fluid container or reservoir 350 and a third exemplary embodiment of a sensor system 360 in accordance with this invention. The refillable fluid reservoir 350 includes a bottom wall 351, a top wall 352, a front wall 353, a rear wall 354, a left wall 355 and a right wall 356. The refillable fluid reservoir 350, which in this exemplary embodiment, is associated with a moving fluid ejection head, travels in a direction 357 along a medium onto which the fluid is to be ejected. The sensor system 360 includes a long prism or sensor target 370, a short prism or sensor target 380 and a detector 390.

In various exemplary embodiments, the long prism or sensor target 370 and the short prism or sensor target 380 are mounted on the top wall 352. The prisms or sensor targets 370 and 380 are oriented downward into the fluid reservoir 350. Alternatively, the prisms or sensor targets 370 and 380 can be mounted on the bottom wall 351 and oriented upward into the refillable fluid reservoir 350. The long prism 370 includes a low first reflective plane 371, a low second reflective plane 372, deep parallel walls 373 and a low planar surface 374 adjacent to or joining with the top wall 352. The short prism 380 includes a high first reflective plane 381, a high second reflective plane 382, shallow parallel walls 383 and a high planar surface 384 separately adjacent to or joining with the top wall 352. The first reflective planes 371 and 381 are joined perpendicular to the second respective reflector planes 372 and 382. The low and high reflective planes 371 and 372, and 381 and 382 form incident angles of 45° to their respective low and high planar surfaces 374 and 384.

The detector 390 is positioned above the refillable fluid reservoir 350 and aligned with the downward oriented prisms 370 and 380 that are mounted on the top 352. In various exemplary embodiments, the detector 390 can be positioned below the fluid reservoir 350 when upward oriented prisms 370 and 380 extend upward from the bottom 351. The detector 390 includes an emitter 392 and a photosensor 394. In various exemplary embodiments, the detector 390 is stationary, while the container 350 travels in the direction 357. In this situation, each prism 370 and 380 passes by the detector 390 separately. Further, the detector 390 can be used to monitor the fluid level from a plurality of fluid reservoirs 350 arranged to pass by the detector 390 in series.

As the long prism 370 passes under the detector 390, the emitter 392 shines a light ray between the deep parallel walls 373 to strike the first low reflective plane 371. For an ink level below the low reflective planes 371 and 372, the light ray will be reflected back to, and detected by, the photosensor 394. The photosensor 394 receiving light thus indicates that the fluid reservoir 350 is effectively empty.

As the short prism 380 passes under the detector 390, the emitter 392 shines a light ray between the shallow parallel walls 383 to strike the first high reflective plane 381. For an ink level above the high reflective planes 381 and 382, the light ray will be refracted into the fluid and will not be detected by the photosensor 394, indicating that the fluid reservoir 350 is full. The light ray reflected by the high reflective planes 381 and 382 while not by the low reflective planes 371 and 372 indicates that the fluid reservoir 350 contains an intermediate level of fluid between full and empty.

It should be appreciated that, in various exemplary embodiments, as the high second reflector plane 382 is progressively uncovered during fluid consumption, or covered during a filling operation, the amount of light will change accordingly. Thus, when the high second reflector plane 382 is mostly covered, only a little light will be reflected from the high second reflector plane 382 to the photosensor 394. As a result, the photosensor 394 will output a low amplitude (or low current) signal. In contrast, when the high second reflector plane 382 is mostly uncovered, more, but less than a full amount of, light will be reflected from the high second reflector plane 382 to the photosensor 394. As a result, the photosensor will output a higher amplitude (or a higher current) signal.

When the output from the detector 390 indicates that the fluid reservoir is effectively empty, the fluid reservoir 350 can be parked for refilling. During the refill operation, the detector 390 can be positioned adjacent to the high level prism 380 and the resulting signal from the detector 390 monitored until a reflected light ray is no longer detected. This condition indicates that the fluid reservoir 350 is full, upon which the refill operation ceases.

Figure 5:
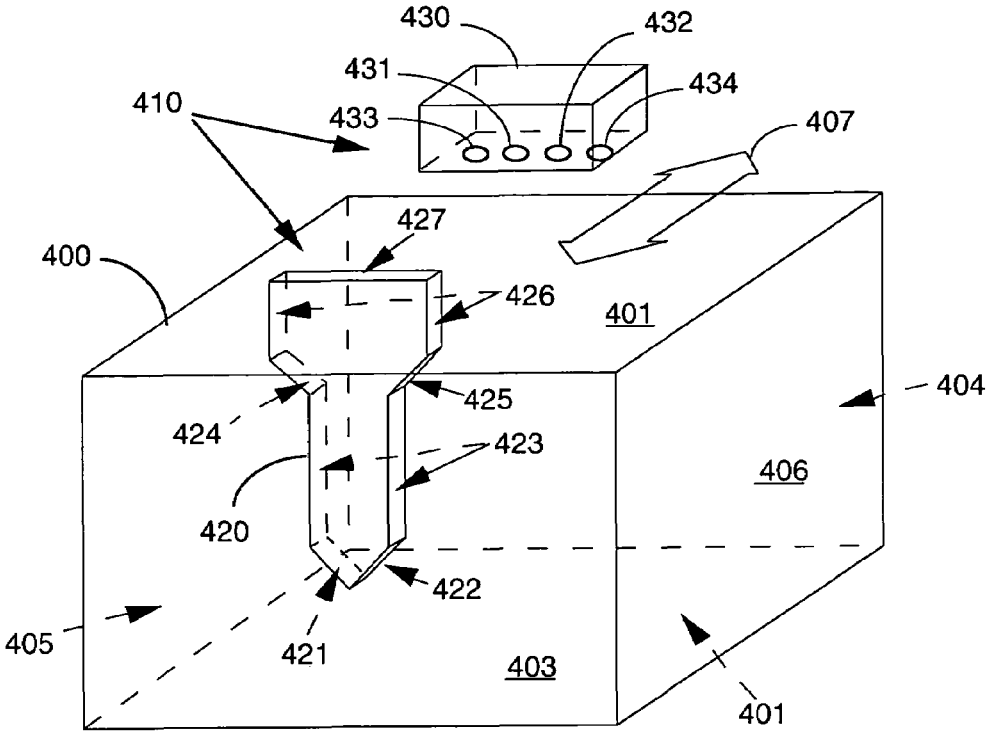
FIG. 5 is an isometric view of a fourth exemplary embodiment of a refillable fluid container having sensors in accordance with this invention.

FIG. 5 shows an isometric view of an exemplary embodiment of a refillable fluid container or reservoir 400 and a fourth exemplary embodiment of a detector device 410 in accordance with this invention. The fluid reservoir 400 includes a bottom wall 401, a top wall 402, a front wall 403, a rear wall 404, a left wall 405 and a right wall 406. The fluid reservoir 400, associated with a moving refillable fluid container, travels in a direction 407, such as along a medium to be printed with fluid ink. The sensor system 410 includes a bifurcated prism or sensor target 420 and a detector 430.

In various exemplary embodiments, the bifurcated prism or sensor target 420 is mounted on the top wall 402 for illustrative purposes. The bifurcated prism 420 or sensor target is oriented downward into the fluid reservoir 400. In various exemplary embodiments, the bifurcated prism or sensor target 420 can be mounted adjacent to or on the bottom wall 401 and oriented upward into the fluid reservoir 400. The bifurcated prism or sensor target 420 includes a low first reflective plane 421, a low second reflective plane 422, deep parallel walls 423, a high first reflective plane 424, a high second reflective plane 425, shallow parallel walls 426 and a planar surface 427 adjacent to or joining with the top wall 402. The shallow parallel walls 426 extend outward beyond the deep parallel walls 423. The first reflective planes 421 and 424 are joined perpendicular to the second respective reflector planes 422 and 425. The reflective planes 421, 422, 424 and 425 form incident angles of 45° to the planar surface 427.

The detector 430 is positioned above the fluid reservoir 400 when the downward-oriented bifurcated prism 420 extends from the top wall 402. Alternatively, the detector 430 can be positioned below the fluid reservoir 400 when an upward oriented prism 420 extends from the bottom 401. The detector 430 includes an inner emitter 431, an inner photosensor 432 an outer emitter 433 and an outer photosensor 434. In various exemplary embodiments, the detector 430 is stationary, while the container 400 travels in the direction 407. In this situation, the bifurcated prisms 420 in several fluid reservoirs 400 pass the detector 430, enabling the fluid level of several fluid reservoirs 400 to be monitored in series.

As the bifurcated prism 420 passes the detector 430, the emitters 431 and 433 shine light rays between the parallel walls 423 and 426 to strike the reflective planes 421 and 424. For fluid levels below the low reflective planes 421 and 422, the light ray will be reflected and thereby detected by the inner photosensor 432. The inner photoreceptor 422 receiving light thus indicates that the fluid reservoir 400 is effectively empty. For fluid levels above the high reflective planes 424 and 425, the light ray will be refracted into the fluid and thus will not be detected by the outer photosensor 434. This indicates that the fluid reservoir 400 is full. When light rays are reflected by the high reflective planes 424 and 425 while light rays are not reflected by the low reflective planes 421 and 422 the fluid reservoir 400 contains an intermediate level of fluid between full and empty. Additionally, the fluid level can be monitored during refilling by determining presence or absence of the fluid at the low level and the high level as the fluid level ascends.

Figure 6:
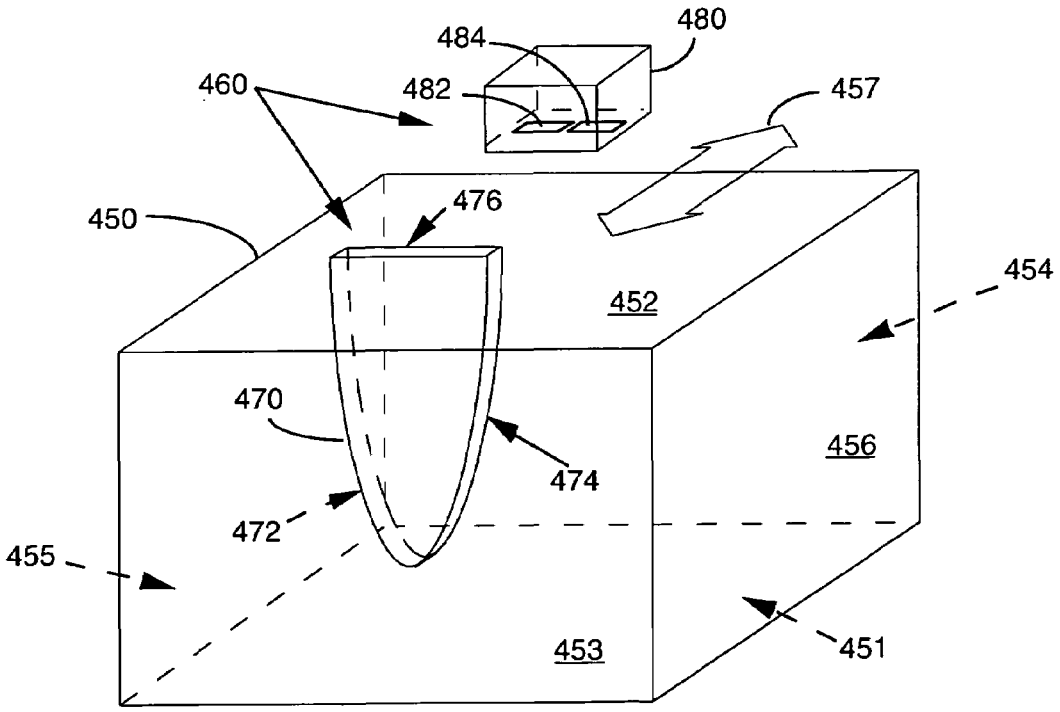
FIG. 6 is an isometric view of a fifth exemplary embodiment of a refillable fluid container having sensors in accordance with this invention.

FIG. 6 shows an isometric view of an exemplary embodiment of a refillable fluid container reservoir 450 and a fifth exemplary embodiment of a sensor system 460 in accordance with this invention. The fluid reservoir 450 includes a bottom wall 451, a top wall 452, a front wall 453, a rear wall 454, a left wall 455 and a right wall 456. The refillable fluid container or reservoir 450, which in this exemplary embodiment, is associated with a moving fluid ejection head, travels in a direction 457 along a medium onto which the fluid is to be ejected. The sensor system 460 includes a bifurcated prism or sensor target 470 and a detector 480.

In various exemplary embodiments, the curvilinear prism or sensor target 470 is mounted adjacent to or on the top wall 452. The curvilinear prism or sensor target 470 is oriented downward into the fluid reservoir 450. In various exemplary embodiments, the curvilinear prism or sensor target 470 can be mounted on the bottom wall 451 and oriented upward to extend into the fluid reservoir 400. The curvilinear prism or sensor target 470 includes a first curved reflective surface 472, a second curved reflective surface 474 and a planar surface 476 adjacent to or joining with the top wall 452. The curvilinear prism or sensor target 470 can exhibit a variety of shapes along the curved reflective surfaces 472 and 474, including a parabolic surface, as shown, or bell-shaped or stepped surfaces. The curved reflective surfaces are symmetric along the midline of the planar surface 476.

The detector 480 is positioned above the fluid reservoir 450 when the downward oriented curvilinear prism or sensor target 470 extends from the top wall 452. In various exemplary embodiments, the detector 480 can be positioned below the fluid reservoir 450 when an upward oriented prism or sensor target 470 is used. The detector 480 includes a spread emitter 482 and a distributed photosensor 484. In various exemplary embodiments, the detector 480 is stationary, while the fluid reservoir 450 travels in the direction 457. In this situation, the curvilinear prism or sensor target 470 in several fluid reservoirs 450 pass the detector 480, enabling the fluid level of several fluid reservoirs 450 to be monitored in series.

As the curvilinear prism 470 passes the detector 480, the spread emitter 482 shines light rays through the planar surface 476 to strike the first reflective surface 472. Depending on the extent at which the spread light rays are reflected by the second reflective surface 472 to the distributed photosensor 484, fluid level at a variety of depths can be determined. For well-chosen reflective surfaces, the fluid level can be monitored over a continuous range between full and empty.

Figure 7:
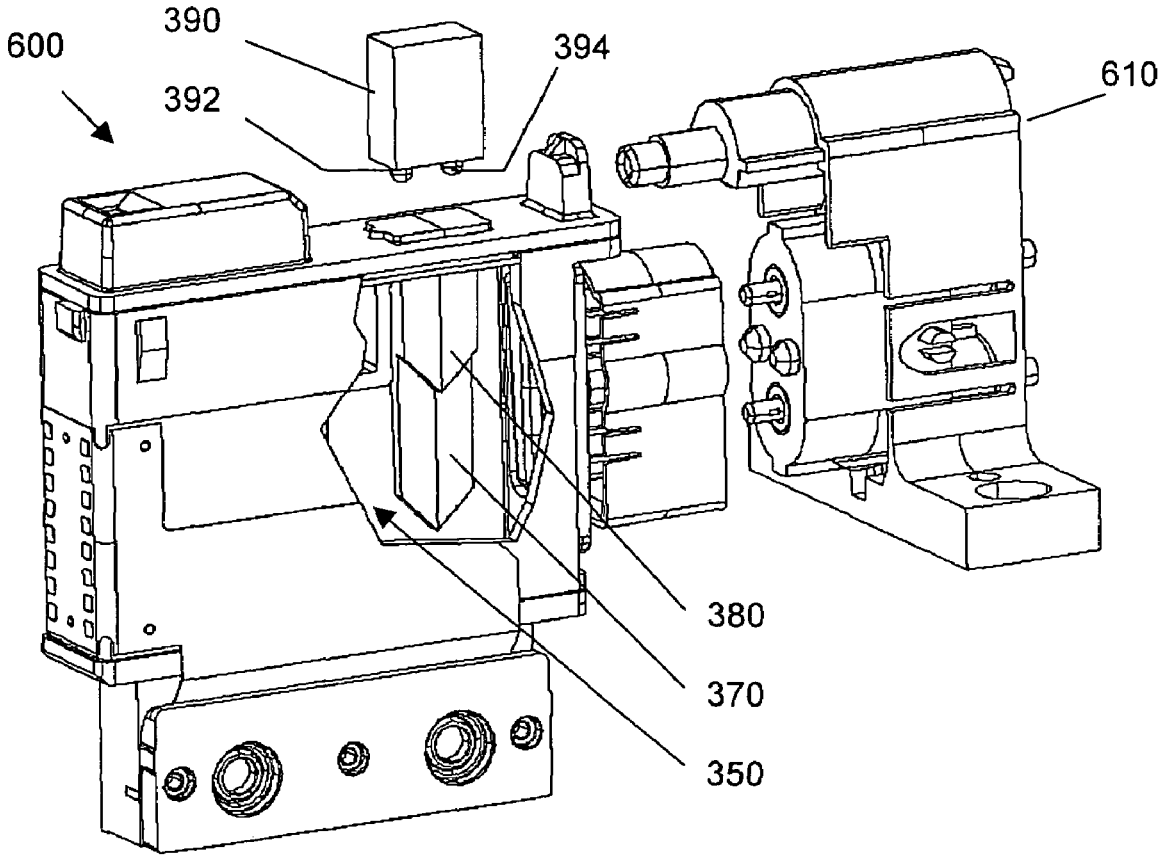
FIG. 7 is an isometric view of an exemplary embodiment of a fluid refill system usable with the fluid level sensors shown in FIGS. 3-6.

FIG. 7 shows a fluid refill system usable with a fluid ejection head 600. The fluid ejection head 600 includes the refillable fluid container or reservoir 350 with the sensor systems 370 and 380 as described in FIG. 4. However, any of the fluid reservoirs and sensor systems shown in any of FIGS. 3, 5 and/or 6 can also be used in the fluid ejection head 600. The fluid reservoir 350 of the fluid ejection head 600 can be connected to a refill station 610 when the detector 390 detects that the fluid level in the fluid reservoir 350 has fallen below the lower prism 370. Subsequently, the fluid reservoir 350 of the fluid ejection head 600 can be disconnected from the refill station 610 when the detector 390 detects that the level in the fluid reservoir 350 has risen to the upper prism 380.

Figure 8:
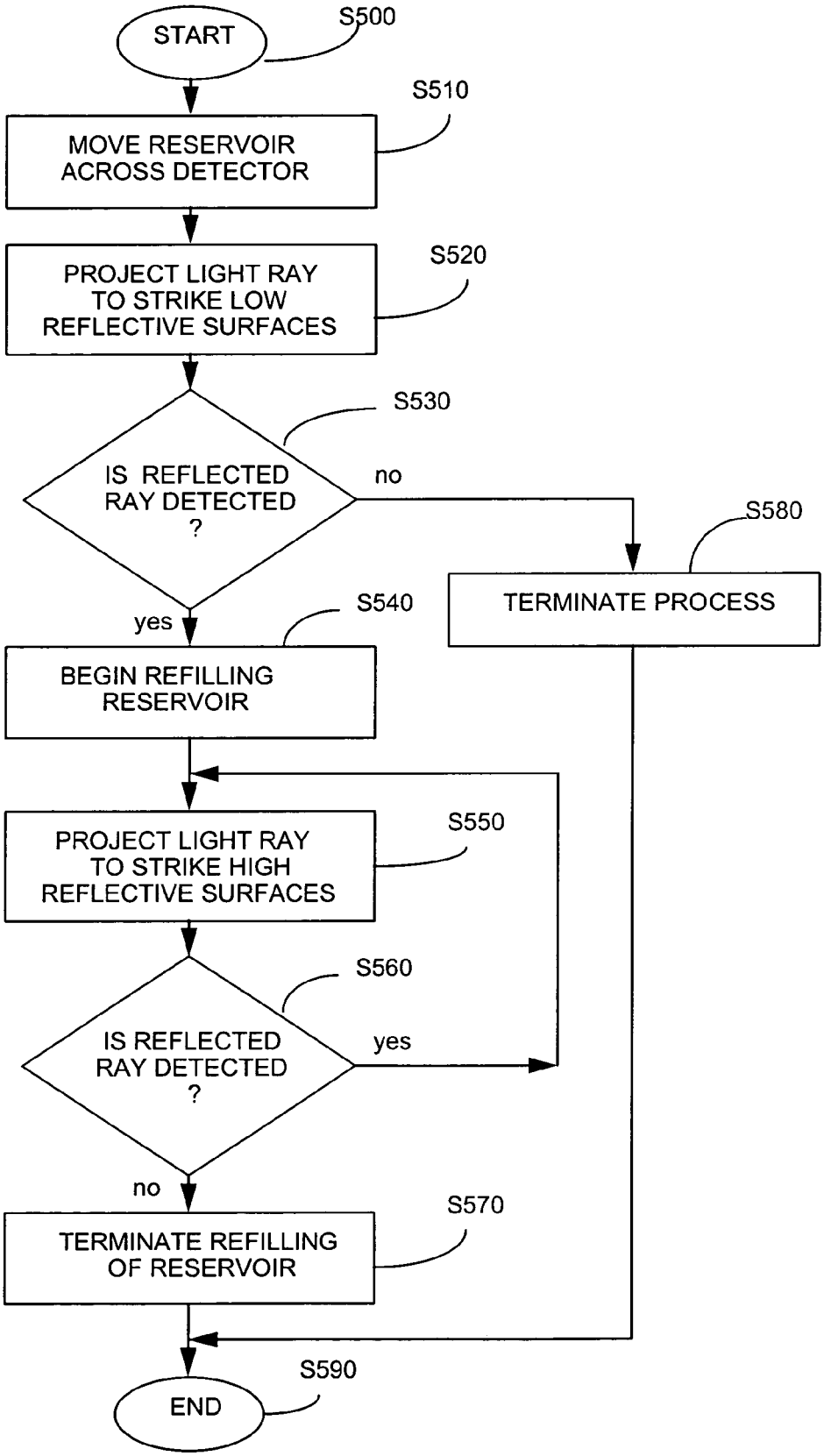
FIG. 8 is a flowchart that outlines one method for determining ink level status in accordance with exemplary embodiments of this invention.

FIG. 8 is a flowchart outlining one exemplary embodiment of a method for monitoring and refilling a fluid reservoir in a fluid ejection head at a refill station. As shown in FIG. 8, beginning in step S500, operation continues to step S510, where the fluid reservoir with a prism pair or sensor target(s) is moved across a detector. Next, in step S520, an emitter projects a light ray through a low planar surface to strike a low first reflective surface. Then, in step S530, a photosensor determines whether or not a reflected ray is detected from a low second reflective surface. If, in step S530, the photosensor detects the reflected ray, operation proceeds to step S540. Otherwise, operation jumps to step S580.

In step S540, the fluid reservoir is flagged as empty and parked at the refill station to refill the fluid reservoir. Then, in step S550, the emitter projects a light ray through a high planar surface to strike a high first reflective surface. Next, in step S560, the photosensor determines whether or not a reflected ray is detected from a high second reflective surface. If the photosensor detects the reflected ray, operation returns to step S540 to continue refilling the fluid reservoir. Otherwise, operation proceeds to step S570.

In step S570, the fluid reservoir is flagged as full and the refill operation is terminated. Operation then jumps to step S590. In contrast, in step S530, when the reflected ray was not detected, the fluid in the fluid reservoir covers the low reflective surfaces. Thus, fluid refilling is not yet needed. Thus, in step S580, the refill operation is immediately terminated. Then, in step S590, operation of the method terminates.

It should be appreciated that step S510 is optional. Thus, in various exemplary embodiments where the fluid reservoir does not move relative to the detector, operation jumps from step S500 directly to step S520.

While this invention has been described in conjunction with exemplary embodiments outlined above, many alternatives, modifications and variations will be apparent to those skilled in the art. Accordingly, the exemplary embodiments of the invention, as set forth above, are intended to be illustrative, not limiting. Various changes can be made without departing from the spirit and scope of the invention.

What is claimed is:

1. A sensor target usable to determine a level of a liquid in a fluid reservoir having a top surface and a bottom surface, the sensor target comprising:

a low prism extending in the fluid reservoir from a transmission surface on at least one of the top surface and the bottom surface to a low position from the bottom surface, the low prism having a low incident surface and a low reflecting surface; and a high prism extending in the fluid reservoir from the transmission surface on the one of the top and bottom surfaces to a high position from the bottom surface, the high prism having a high incident surface and a high reflecting surface, wherein:

light is projected from a single source through the transmission surface into the low prism to the low incident surface and the high prism to the high incident surface, the light is reflected from the low reflecting surface of the low prism through the transmission surface when the level of the fluid is below the low prism, the light is reflected from the high reflecting surface of the high prism through the transmission surface when the level of the fluid is below the high prism, and the light is projected through the low and high prisms at separate time intervals.

2. A refillable fluid container having at least one sensor structure usable to determine a level of a fluid in the fluid container between a top surface and a bottom surface, each at least one sensor structure comprising:

a low prism extending in the fluid reservoir from a transmission surface on at least one of the top surface and the bottom surface to a low position from the bottom surface, the low prism having a low incident surface and a low reflecting surface; and a high prism extending in the fluid reservoir from the transmission surface on the one of the top and bottom surfaces to a high position from the bottom surface, the high prism having a high incident surface and a high reflecting surface, wherein light projects from a single source through the transmission surface into the low prism to the low incident surface and the high prism to the high incident surface at separate time intervals, the sensor structure reflects light reflected from the low reflecting surface of the low prism through the transmission surface when the level of the fluid is below the low prism, the sensor structure reflects light reflected from the high reflecting surface of the high prism through the transmission surface when the level of the fluid is below the high prism.

3. A method for determining a level of a fluid in a refillable fluid container having a top surface and a bottom surface, the method comprising:

introducing light from a single source through a transmission surface into a low prism and a high prism at separate time intervals, wherein the low and high prisms extend from the transmission surface on at least one of the top and bottom surfaces;

detecting whether the introduced light is reflected from at least one of the low prism and the high prism; and determining that the refillable fluid container is in an empty condition in response to detecting light reflected from the low prism.

4. The method according to claim 3, wherein introducing light comprises:

emitting light from an emitter; and introducing the emitted light into the at least one of the low prism and the high prism.

5. The method according to claim 3, wherein detecting the reflected light comprises directing the reflected light to a photosensor.

6. A sensor usable to determine a level of a fluid in a fluid reservoir having a top surface and a bottom surface, the sensor comprising:

an emitter that projects light;

a photosensor;

a low prism extending in the fluid reservoir from a transmission surface on at least one of the top surface and the bottom surface to a low position from the bottom surface, the low prism having a low incident surface and a low reflecting surface; and a high prism extending in the fluid reservoir from the transmission surface on the one of the top and bottom surfaces to a high position from the bottom surface, the high prism having a high incident surface and a high reflecting surface, wherein:

the emitter projects the light through the transmission surface into at least one of the low prism to the low incident surface and the high prism to the high incident surface, the photosensor senses light reflected from the low reflecting surface of the low prism through the transmission surface when the level of the fluid is below the low prism, the photosensor further senses light reflected from the high reflecting surface of the high prism through the transmission surface when the level of the fluid is below the high prism, and the emitter projects the light through the low and high prisms at separate time intervals.

7. The sensor according to claim 6, wherein the fluid reservoir having the low and high prisms is moved across the emitter and the photosensor.

8. A sensor usable to determine a level of a fluid in a fluid reservoir, the sensor comprising:

an emitter that projects light;

a photosensor;

a low prism extending in the fluid reservoir to a low position, the low prism having a low incident surface and a low reflecting surface;

a high prism extending in the fluid reservoir to a high position, the high prism having a high incident surface and a high reflecting surface; and a refill station that refills the fluid reservoir in response to the photosensor detecting light reflected from the low prism, and that terminates the refilling in response to the photosensor ceasing to detect light reflected from the high prism, wherein:

the emitter projects the light through at least one of the low prism to the low incident surface and the high prism to the high incident surface, the photosensor senses light reflected from the low prism when the level of the fluid is below the low prism, the photosensor further senses light reflected from the high reflecting surface of the high prism through the transmission surface when the level of the fluid is below the high prism, and the emitter projects the light through the low and high prisms at separate time intervals.

9. A fluid ejection head having a fluid reservoir, the fluid reservoir having a top surface, a bottom surface and at least one sensor structure usable to determine a level of a fluid in the fluid reservoir from the bottom surface, each at least one sensor structure comprising:

an emitter that projects light;

a photosensor;

a low prism extending in the fluid reservoir from a transmission surface on at least one of the top surface and the bottom surface to a low position from the bottom surface, the low prism having a low incident surface and a low reflecting surface; and a high prism extending in the fluid reservoir from the transmission surface on the one of the top and bottom surfaces to a high position from the bottom surface, the high prism having a high incident surface and a high reflecting surface, wherein the emitter projects the light through the transmission surface into at least one of the low prism to the low incident surface and the high prism to the high incident surface, the photosensor senses light reflected from the low reflecting surface of the low prism through the transmission surface when the level of the fluid is below the low prism, the photosensor further senses light reflected from the high reflecting surface of the high prism through the transmission surface when the level of the fluid is below the high prism, and the emitter projects the light through the low and high prisms at separate time intervals.

10. The fluid ejection head according to claim 9, wherein the fluid reservoir having the low and high prisms moves past the emitter and the photo sensor.

11. The fluid ejection head according to claim 10, wherein the low and high prisms form a bifurcated prism.

12. The fluid ejection head according to claim 9, wherein the emitter and the photosensor have fixed positions relative to both of the low and high prisms.

* * * * *